US012723476B2

(12) United States Patent
Mohideen

(10) Patent No.: US 12,723,476 B2
(45) Date of Patent: Sep. 1, 2026

(54) AUTOMATED DRILLING ARRANGEMENT

(71) Applicant: Farlin Anooz Mohideen, Belmont (AU)

(72) Inventor: Farlin Anooz Mohideen, Belmont (AU)

( * ) Notice: Subject to any disclaimer, the term of this patent is extended or adjusted under 35 U.S.C. 154(b) by 0 days.

(21) Appl. No.: 18/857,156

(22) PCT Filed: May 26, 2023

(86) PCT No.: PCT/AU2023/050448
§ 371 (c)(1),
(2) Date: Oct. 15, 2024

(87) PCT Pub. No.: WO2023/225721
PCT Pub. Date: Nov. 30, 2023

(65) Prior Publication Data

US 2025/0154837 A1 May 15, 2025

(30) Foreign Application Priority Data

May 27, 2022 (AU) ..... 2022901437

(51) Int. Cl.
*E21B 19/20* (2006.01)
*E21B 7/02* (2006.01)
(Continued)

(52) U.S. Cl.
CPC ..... *E21B 19/20* (2013.01); *E21B 7/023* (2013.01); *E21B 15/003* (2013.01); *E21B 19/087* (2013.01); *E21B 19/155* (2013.01)

(58) Field of Classification Search
CPC ..... E21B 19/20; E21B 19/087; E21B 19/155; E21B 19/15; E21B 19/16–19/168
See application file for complete search history.

(56) References Cited

U.S. PATENT DOCUMENTS 3,631,933 A * 1/1972 Bryant ..... E21B 7/00 175/57
6,550,128 B1 4/2003 Lorenz
(Continued)

FOREIGN PATENT DOCUMENTS

WO 2010/046757 A1 4/2010
WO 2017/185164 A1 11/2017

OTHER PUBLICATIONS

Drill Rig Fraste MULTIDRILL XL 170 for Water Well, https://www.youtube.com/watch?v=gxtR0RuecVc, published Nov. 21, 2014 (Year: 2014).*

(Continued)

*Primary Examiner* — Giovanna Wright
(74) *Attorney, Agent, or Firm* — Cherskov Flaynik & Gurda, LLC

(57) ABSTRACT

Provided is an automated drilling arrangement comprising a platform, a drill pipe loading assembly arranged on the platform and including a cradle for receiving a drill pipe section, and a handler assembly configured automatically to displace and orientate said drill pipe section from the cradle into an upright position for engagement with a drill string. Arrangement also includes a drilling mast arranged on the platform and comprising a rotary head drive displaceable along the mast to effect drilling, and a drill pipe manipulator configured automatically to receive, align and connect said section of drill pipe from the handler assembly with a drill string of the rotary head drive to facilitate automated drilling by the automated drilling arrangement.

15 Claims, 12 Drawing Sheets

(51) Int. Cl.

| | |
|---|---|
| ***E21B 15/00*** | (2006.01) |
| ***E21B 19/087*** | (2006.01) |
| ***E21B 19/15*** | (2006.01) |

(56) References Cited

U.S. PATENT DOCUMENTS

| | | | | |
|---|---|---|---|---|
| 2013/0341002 | A1 | 12/2013 | Flusche | |
| 2014/0209382 | A1 | 7/2014 | Smith et al. | |
| 2017/0321501 | A1* | 11/2017 | Comacchio | E21B 7/02 |
| 2021/0054701 | A1 | 2/2021 | Holck | |
| 2021/0355758 | A1* | 11/2021 | Lien | E21B 19/15 |
| 2022/0018207 | A1* | 1/2022 | Humphrey | E21B 33/1277 |

OTHER PUBLICATIONS

Drill Rig Fraste FS 500 with Manipulator Rods Loader https://www.youtube.com/watch?v=wZG69pffcmU, published Oct. 10, 2013 (Year: 2013).*

FRASTE Multidrill XL 170—Water Well, Geotechnical, Geothermal Drill Rig https://www.youtube.com/watch?v=TDh9CAnLBXY, Jun. 6, 2018 (Year: 2018).*

Drill Rig Fraste ML 150 on truck with drill pipes manipulator <URL: https://www.youtube.com/watch?v=FN5VFU6AxY>, Published Apr. 29, 2013.

* cited by examiner

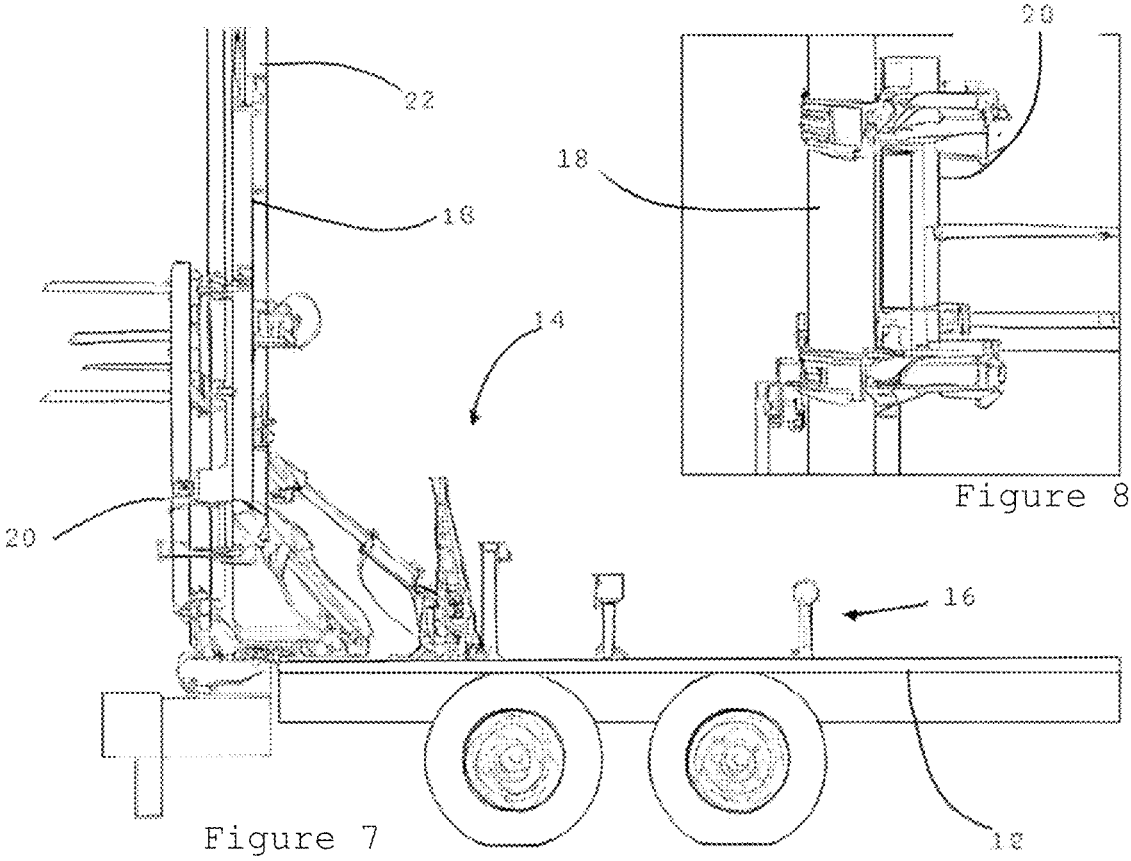
Figure 7
Figure 8
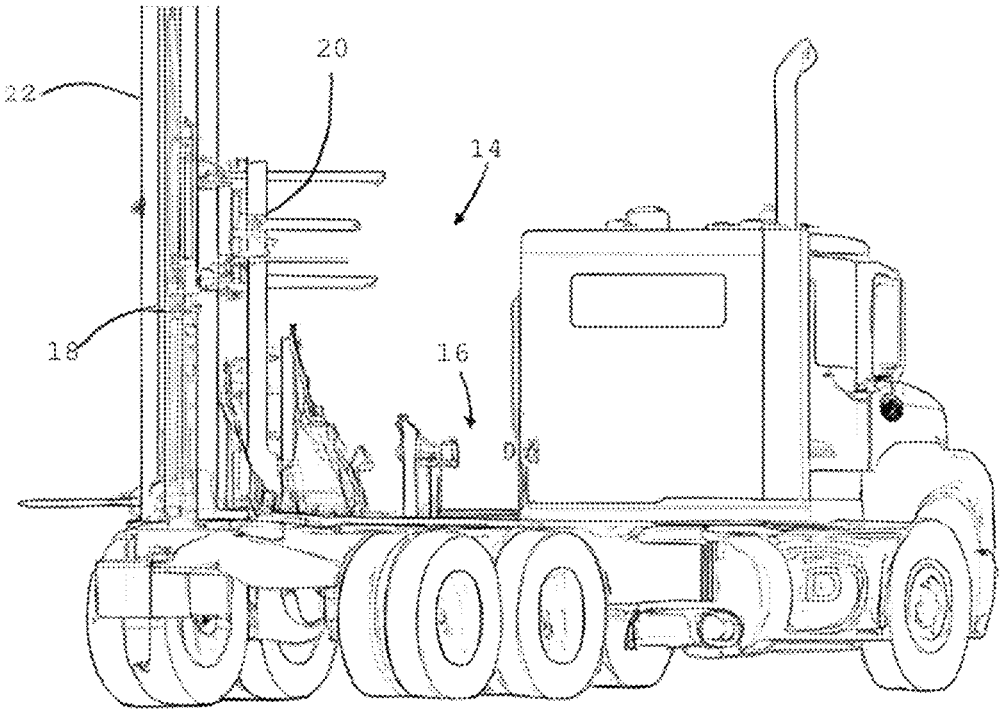
Figure 9

AUTOMATED DRILLING ARRANGEMENT

TECHNICAL FIELD

This invention relates broadly to the field of drilling, and more specifically to an automated drilling arrangement and an associated method of drilling.

BACKGROUND ART

The following discussion of the background art is intended to facilitate an understanding of the present invention only. The discussion is not an acknowledgement or admission that any of the material referred to is or was part of the common general knowledge as at the priority date of the application.

As generally known in the art, a drilling rig is an integrated system that drills wells, such as oil or water wells. Drilling rigs can also be used to sample sub-surface mineral deposits, test rock, soil and groundwater physical properties, and can also be used to install sub-surface fabrications, such as underground utilities, instrumentation, tunnels or wells. Drilling rigs can be mobile equipment mounted on trucks, tracks or trailers, or more permanent land or marine-based structures. The term "rig" generally refers to the equipment that is collectively used to penetrate the surface of the Earth's crust.

A drill string on a drilling rig is a column, or string, of drill pipe that typically transmits drilling fluid via mud pumps and torque via a top drive to the drill bit. Drill pipe generally makes up the majority of a drill string from the drill bit back up to the surface. Each drill pipe typically comprises a long tubular section with a specified outside diameter. Each end of a drill pipe section is generally threaded which allows for the mating of each drill pipe segment to the next segment via suitable male and female thread.

Drilling by means of a drill rig is generally labour intensive and often dangerous work due to the requirement to move large sections of drill pipe for attachment onto (or detachment from) the drill string as the drill string penetrates the subsurface (or is subsequently removed after drilling). The drill mast or derrick also generally contains a top drive for rotating the drill string, along with various other pieces of machinery, making a drill rig a dangerous area for personnel due to movement and displacement of equipment, often resulting in injuries, or even fatalities.

In particular, automatic threading and unthreading of drill pipe sections, which is necessary for automated drilling, present particular difficulties, as proper threading alignment is necessary to effect automated drilling without requiring human monitoring or management. Such semi-automated drill rigs exist, such as that described in WO 2010/046757 A1 to FRASTE S.P.A, which shows a semi-automated drill rig which requires human monitoring and regulation during drilling. Human-managed operation of the FRASTE S.P.A system can also be seen at https://www.youtube.com/watch?v=F N5VFU6AxY.

In particular, the arrangement disclosed in the FRASTE S.P.A document requires human control, particularly during threading or unthreading of drill pipe sections, where human monitoring is required to align threading of one drill pipe section to another in order to drill. The FRASTE S.P.A further describes the use of a conventional so-called double breakout clamp or locking assembly, which generally features two hydraulic jaws for simultaneously gripping a drill pipe section to facilitate threading. Specifically, such a double breakout clamp is specifically designed to allow for unthreading of stuck drill pipe sections, where the sets of hydraulic jaws rotate relative to each other to unscrew stuck pipe threads.

In light hereof, Applicant has identified a need for a safer and less labour-intensive drilling arrangement, and specifically a drilling arrangement whereby automated, accurate threading of drill pipe is possible without requiring human intervention, and the current invention was conceived with this goal in mind.

SUMMARY OF THE INVENTION

According to a first aspect of the invention there is provided an automated drilling arrangement comprising:

- a platform;
- a drill pipe loading assembly arranged on the platform and including a cradle for receiving a drill pipe section, and a handler assembly configured automatically to displace and orientate said drill pipe section from the cradle into an upright position for engagement with a drill string; and
- a drilling mast arranged on the platform and comprising a rotary head drive displaceable along the mast to effect drilling, and a drill pipe manipulator configured automatically to receive, align and connect said section of drill pipe from the handler assembly with a drill string of the rotary head drive to facilitate automated drilling by the automated drilling arrangement.

The skilled addressee is to appreciate that operation of the handler assembly and drill pipe manipulator as part of the overall operation of the drilling arrangement is generally reversible in order to remove drill pipe sections from a well. Accordingly, description of such drilling operation herein includes an inverse order, as appropriate.

In an embodiment, the platform comprises a mobile platform, such as a flatbed truck, a tracked platform, or the like.

In an embodiment, the mobile platform comprises an automated or self-driving platform.

In an embodiment, the platform comprises energising means for the drill pipe loading assembly and drilling mast, such as an internal combustion engine and electrical, pneumatic and/or hydraulic and/or generator(s) actuator(s) for energising constituent components of the drilling arrangement.

In an embodiment, the drilling arrangement includes an automated loader configured automatically to load sections of drill pipe from a drill pipe supply onto the cradle.

In an embodiment, the drill pipe supply comprises a truck loaded with a supply of drill pipe sections.

In an embodiment, the automated loader comprises an automated or self-driving platform.

In an embodiment, the automated loader comprises a robotic arm arranged on the drill pipe supply and configured automatically to load drill pipe sections from the drill pipe supply onto the cradle.

In an embodiment, the cradle of the drill pipe loading assembly comprises at least two pipe roller cradles for receiving a drill pipe section in a substantially horizontal position.

In an embodiment, the cradle is laterally arranged with the drilling mast.

In an embodiment, the handler assembly comprises a mechanism configured to grasp a drill pipe section in the cradle, hoist the t gripped drill pipe section into a substantially upright orientation, and to swivel the upright drill pipe section from proximate the cradle towards the drill string.

In an embodiment, the handler assembly mechanism is configured to laterally displace the upright drill pipe section underneath the rotary head drive.

In an embodiment, the drilling mast is pivotably arranged on the platform so that the mast is deployable between a transport position, in which the mast lies proximate the platform, and a drilling position, in which the mast is in a substantially upright position to effect drilling.

In an embodiment, the drill pipe manipulator comprises at least two pipe clamp pairs layered on each other, the pipe clamp pairs each configured selectively to clamp or release an end of a drill pipe section to facilitate automatic threaded interconnection of successive drill pipe sections.

Typically, the two layered pipe clamp pairs are rotatably arranged with respect to each other co-axially about drill pipe sections within the drill pipe manipulator to facilitate threaded interconnection of successive drill pipe sections.

In an embodiment, the drill pipe manipulator comprises at least one pipe aligner layered on a pipe clamp pair and which is configured to align an end of a drill pipe section with an end of a successive drill pipe section to facilitate automatic threaded interconnection of said drill pipe sections.

In an embodiment, the pipe aligner comprises pipe rollers for abutting against a drill pipe section to allow the aligner to displace an end of the drill pipe section laterally whilst the drill pipe section is able to move longitudinally through the drill pipe manipulator.

In an embodiment, the automated drilling arrangement comprises a control system including sensors for sensing relative positions of drill pipe sections and to complementarily control the energising means, actuators, automated loader, handler assembly, and/or drill pipe manipulator, as required, to facilitate automated drilling by the automated drilling arrangement.

According to a second aspect of the invention there is provided a method of drilling, said method comprising the steps of:

- providing an automated drilling arrangement comprising a platform with a drilling mast arranged thereon and including a rotary head drive displaceable along the mast to effect drilling, a drill pipe loading assembly arranged on the platform and including a cradle for receiving a drill pipe section;
- automatically displacing and orientating the drill pipe section, by means of an automated handler assembly on the platform, from the cradle into an upright position for engagement with a drill string of the rotary head drive;
- automatically receiving, aligning and connecting the section of drill pipe from the handler assembly, by means of a drill pipe manipulator of the drilling mast, with the drill string of the rotary head drive; and
- drilling with the drill string.

In an embodiment, the platform comprises a mobile platform, such as a flatbed truck, a tracked platform, or the like.

In an embodiment, the platform comprises energising means for the drill pipe loading assembly and drilling mast, such as an internal combustion engine and electrical, pneumatic and/or hydraulic generator(s) and/or actuator(s) for energising constituent components of the drilling arrangement.

In an embodiment, the method includes the step of automatically loading sections of drill pipe from a drill pipe supply onto the cradle by means of an automated loader.

In an embodiment, the drill pipe supply comprises a truck loaded with a supply of drill pipe sections.

In an embodiment, the automated loader comprises a robotic arm arranged on the drill pipe supply and configured automatically to load drill pipe sections from the drill pipe supply onto the cradle.

In an embodiment, the cradle of the drill pipe loading assembly comprises at least two pipe roller cradles for receiving a drill pipe section in a substantially horizontal position.

In an embodiment, the cradle is laterally arranged with the drilling mast.

In an embodiment, the handler assembly comprises a mechanism configured to grasp a drill pipe section in the cradle, hoist the gripped drill pipe section into a substantially upright orientation, and to swivel the upright drill pipe section from proximate the cradle towards the drill string.

In an embodiment, the handler assembly mechanism is configured to laterally displace the upright drill pipe section underneath the rotary head drive.

In an embodiment, the drilling mast is pivotably arranged on the platform so that the mast is deployable between a transport position, in which the mast lies proximate the platform, and a drilling position, in which the mast is in a substantially upright position to effect drilling.

In an embodiment, the drill pipe manipulator comprises at least two pipe clamp pairs layered on each other, the pipe clamp pairs each configured to clamp or release an end of a drill pipe section to facilitate automatic threaded interconnection of successive drill pipe sections.

Typically, the two layered pipe clamp pairs are rotatably arranged with respect to each other co-axially about drill pipe sections within the drill pipe manipulator to facilitate threaded interconnection of successive drill pipe sections.

In an embodiment, the drill pipe manipulator comprises at least one pipe aligner layered on a pipe clamp pair and which is configured to align an end of a drill pipe section with an end of a successive drill pipe section to facilitate automatic threaded interconnection of said drill pipe sections.

In an embodiment, the pipe aligner comprises pipe rollers for abutting against a drill pipe section to allow the aligner to displace an end of the drill pipe section laterally whilst the drill pipe section is able to move longitudinally through the drill pipe manipulator.

According to a further aspect of the invention there is provided an automated method of drilling comprising the step of drilling by means of the automated drilling arrangement in accordance with the first aspect of the invention.

According to a further aspect of the invention there is provided an automated drilling arrangement and an associated method of drilling, substantially as herein described and/or illustrated.

BRIEF DESCRIPTION OF THE DRAWINGS

The description will be made with reference to the accompanying drawings in which:

FIG. 7 is a diagrammatic side-view representation of the handler assembly of FIG. 8 hoisting a drill pipe section upright;

FIG. 8 is a diagrammatic closer-view representation of the handler assembly of FIG. 7 grasping a section of drill pipe;

FIG. 9 is diagrammatic rear-perspective representation of the handler assembly of FIG. 7;

DETAILED DESCRIPTION OF EMBODIMENTS

Figure 1:
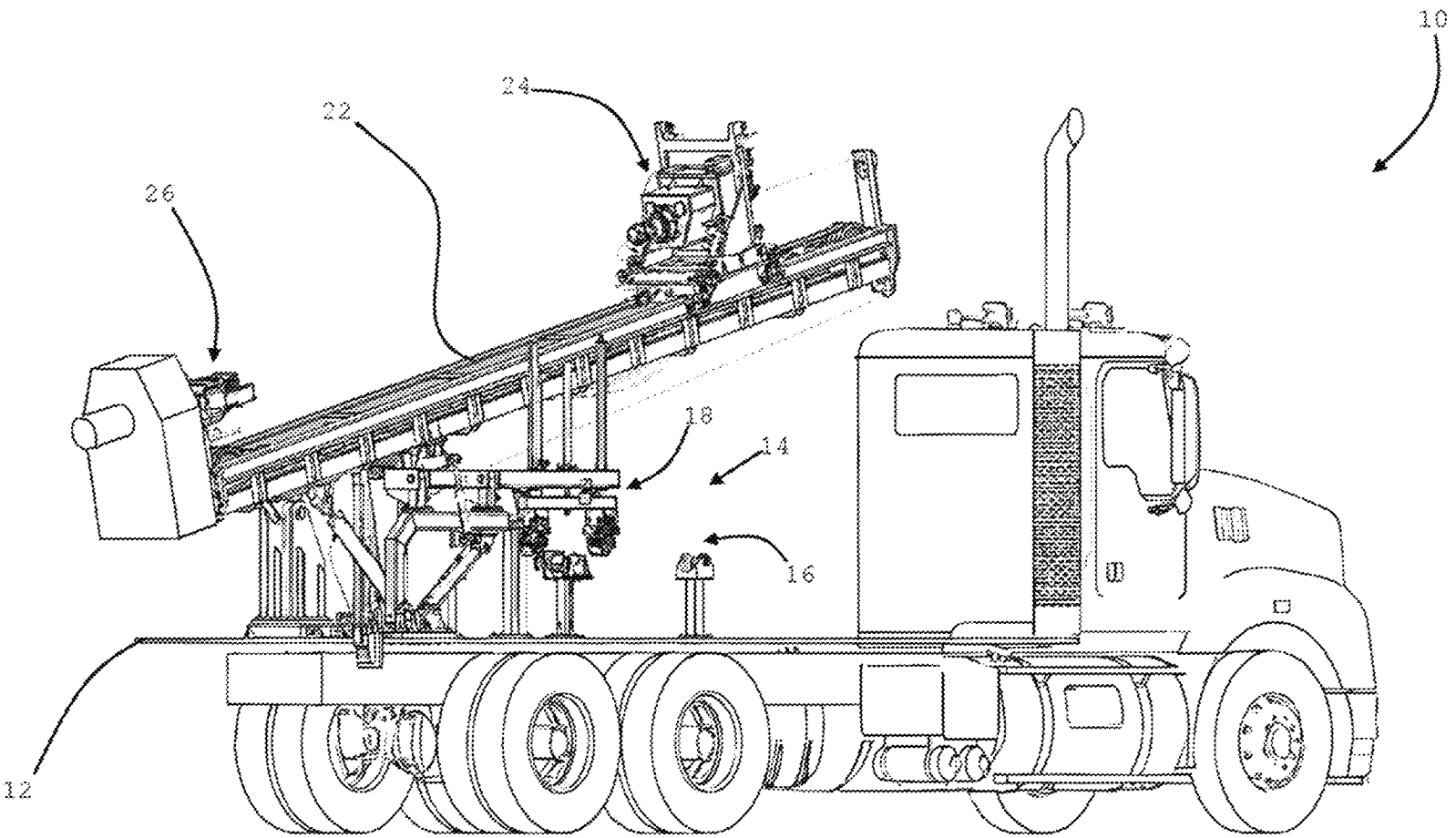
FIG. 1 is a diagrammatic rear perspective representation of an automated drilling arrangement in accordance with aspects of the present invention.
Figure 2:
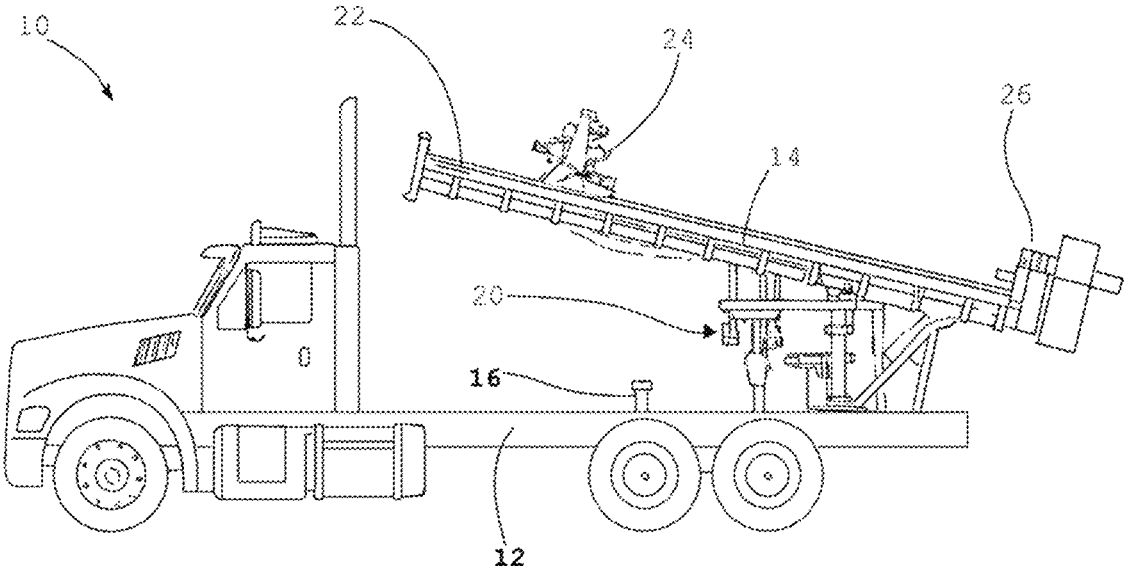
FIG. 2 is a diagrammatic side representation of the automated drilling arrangement of FIG. 1, showing a drilling mast in a transport position.
Figure 3:
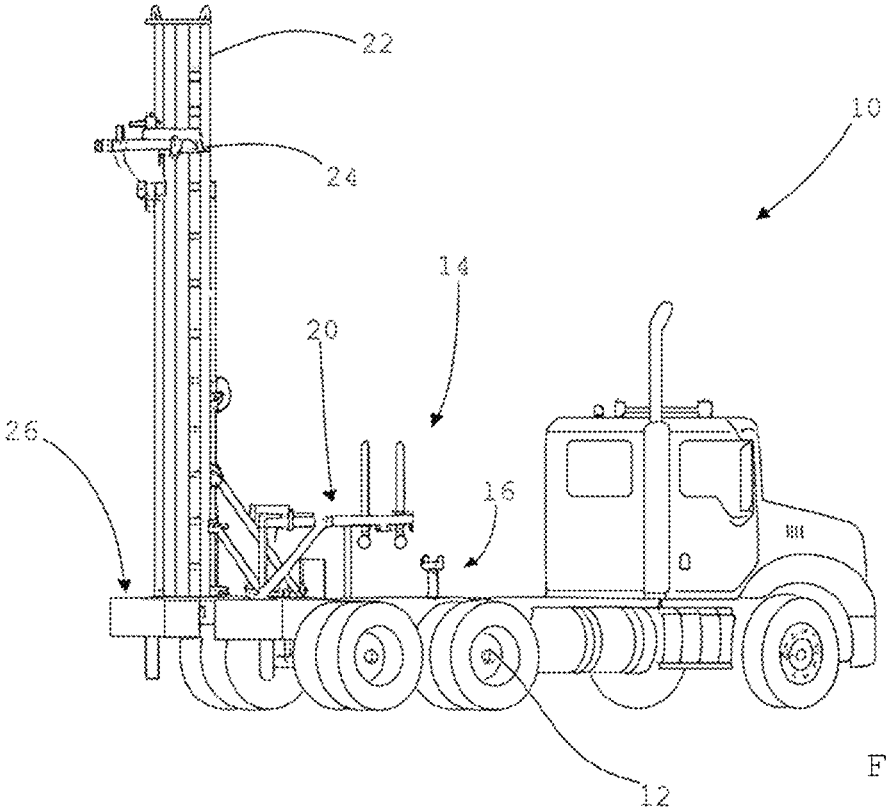
FIG. 3 is diagrammatic rear perspective representation of the automated drilling arrangement of FIG. 1, showing a drilling mast in a drilling position.
Figure 4:
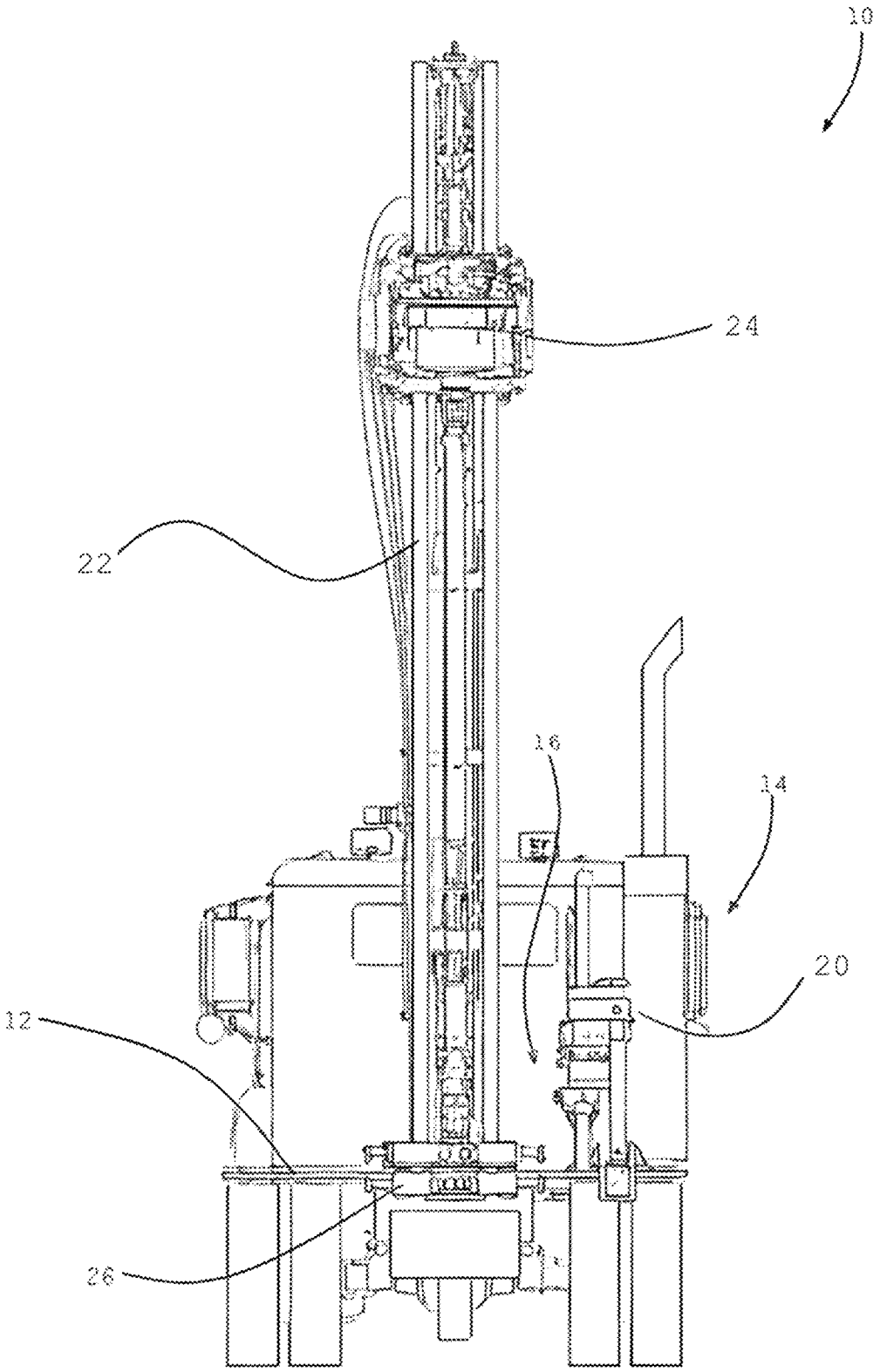
FIG. 4 is a diagrammatic rear-view representation of the automated drilling arrangement of FIG. 3.
Figure 5:
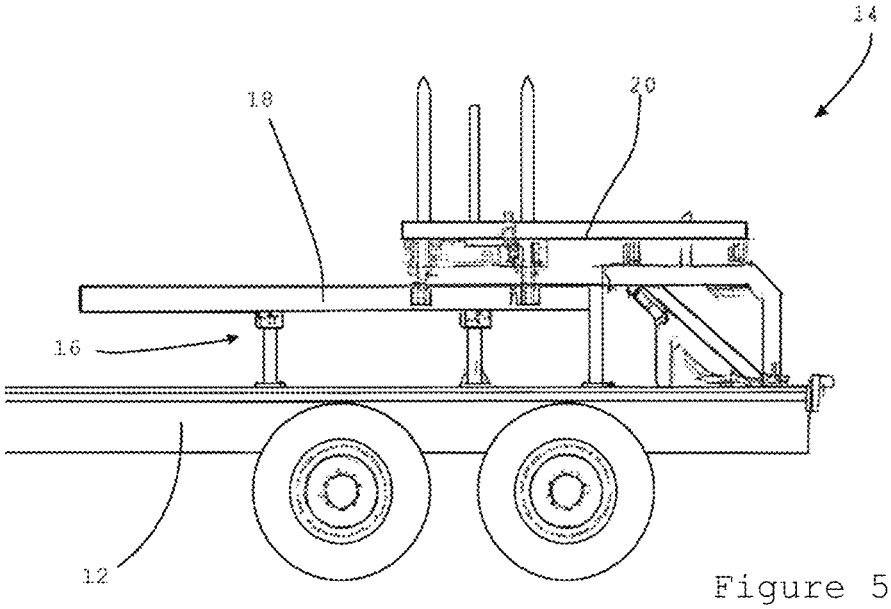
FIG. 5 is a diagrammatic side-view representation of a drill pipe loading assembly of the automated drilling arrangement of FIG. 1.
Figure 6:
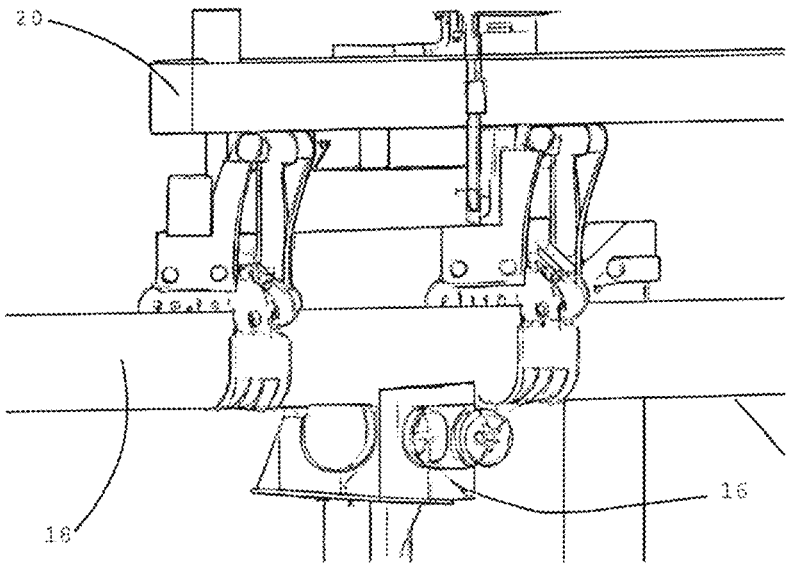
FIG. 6 is a diagrammatic closer-view representation of a handler assembly of the drill pipe loading assembly of FIG. 5.
Figure 10:
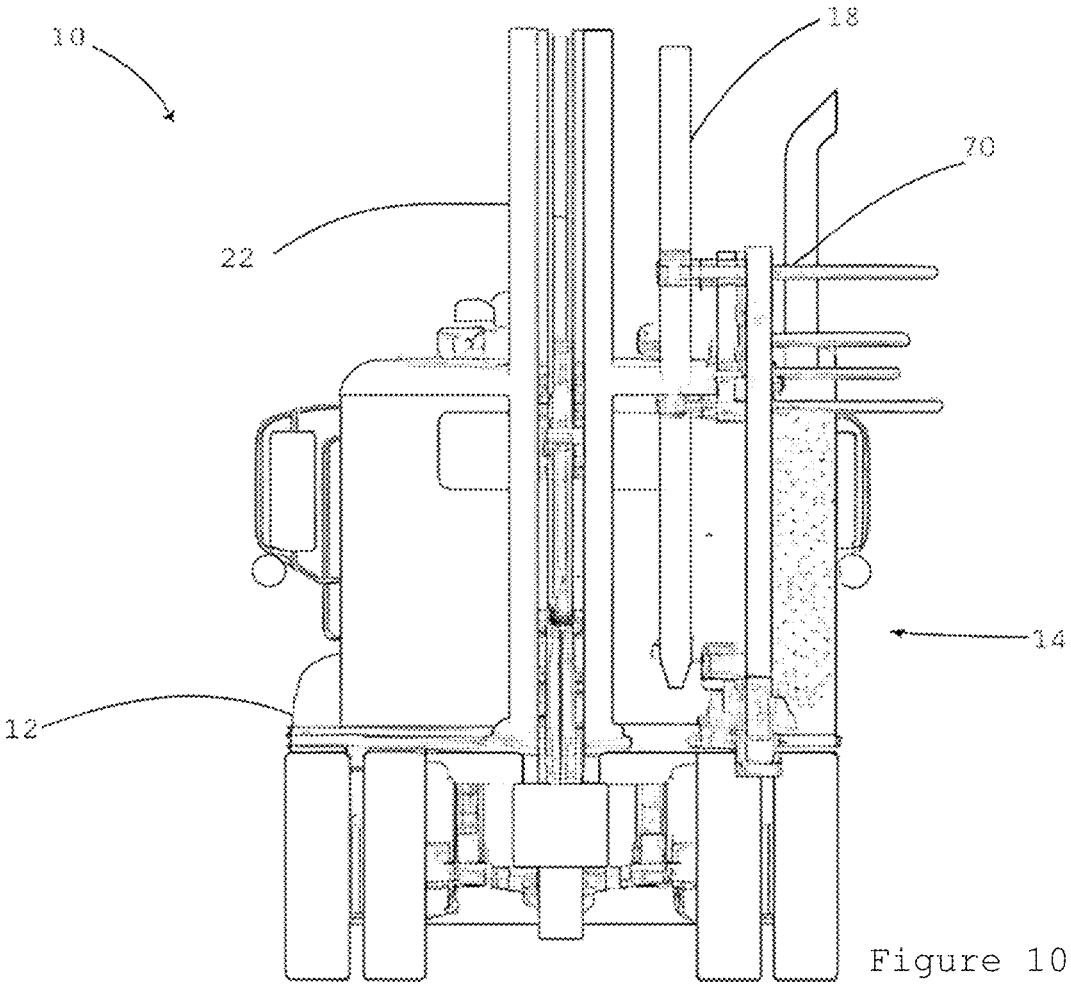
FIG. 10 is a diagrammatic rear representation of the handler assembly of FIG. 7 swivelling the upright drill pipe section from the cradle towards the drill string.
Figure 11:
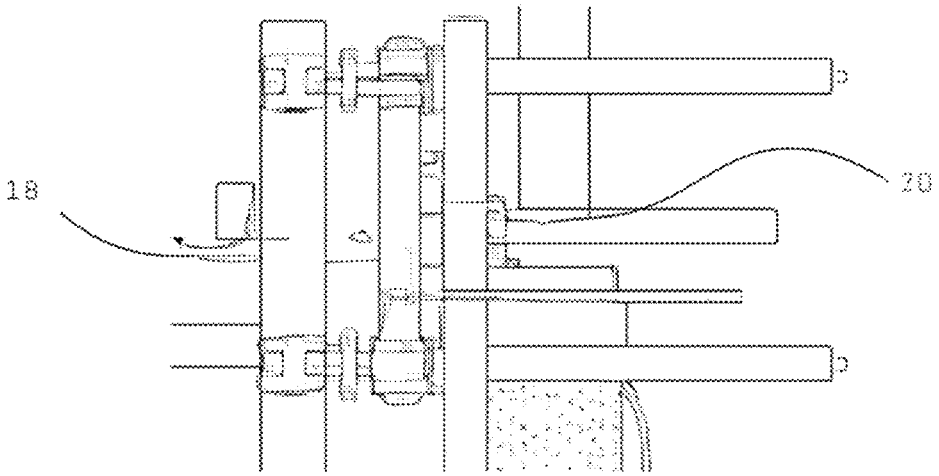
FIG. 11 is a diagrammatic closer-view representation of the handler assembly of FIG. 10 showing actuators for laterally displacing the upright drill pipe section underneath the rotary head drive.
Figure 12:
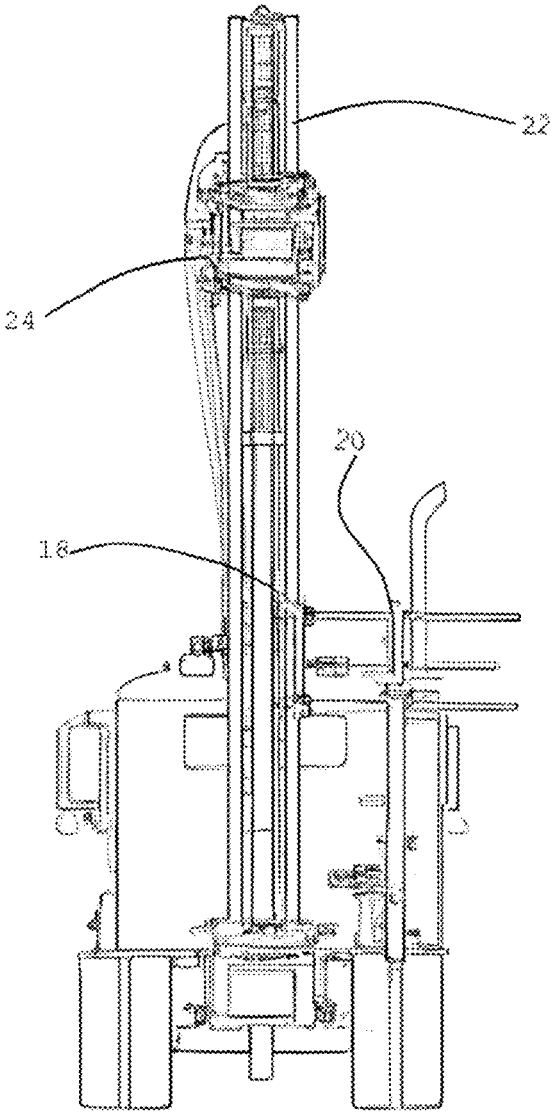
FIG. 12 is a diagrammatic rear-view representation of the handler assembly of FIG. 11.
Figure 13:
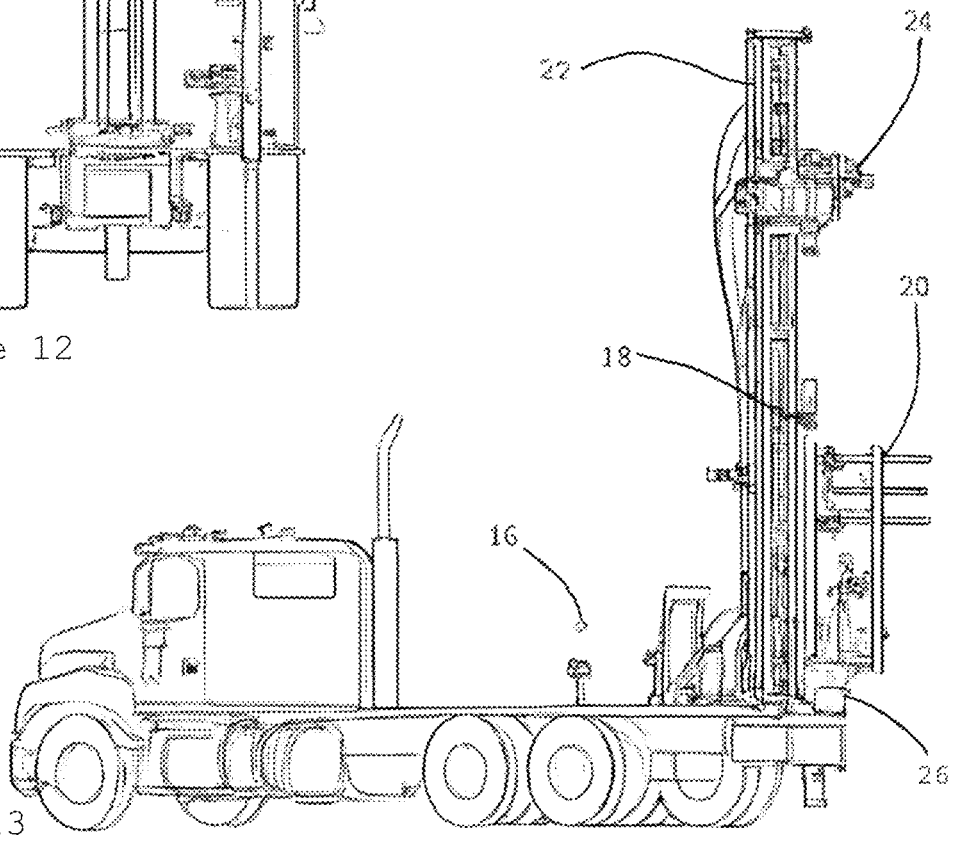
FIG. 13 is a diagrammatic rear-perspective representation of the handler assembly of FIG. 12.
Figure 14:
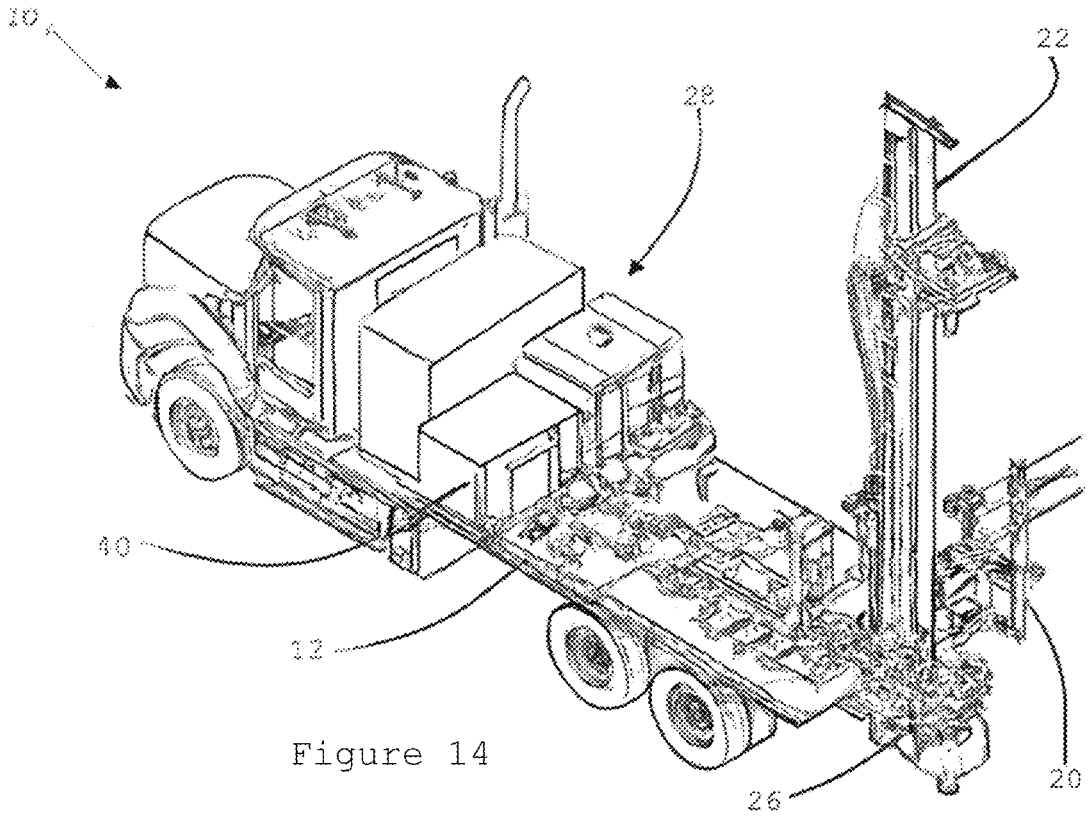
FIG. 14 is a diagrammatic top rear perspective representation of the automated drilling arrangement with a section of drill pipe interconnected with a drill string.
Figure 15:
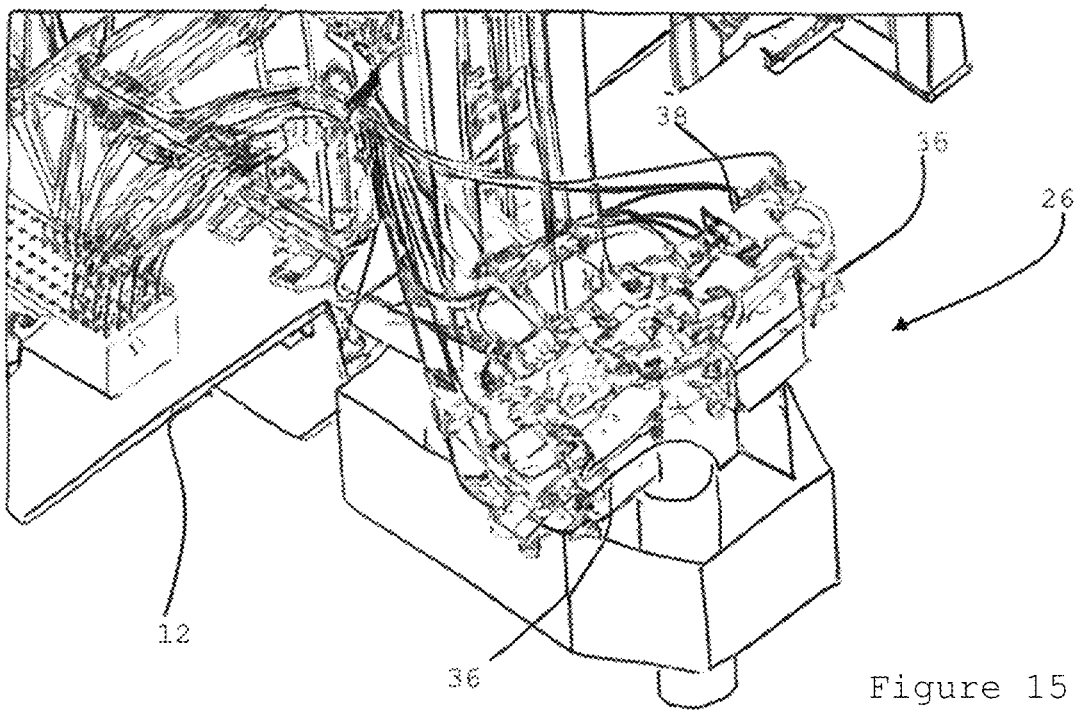
FIG. 15 is diagrammatic representation of a drill pipe manipulator of the automated drilling arrangement.

Further features of the present invention are more fully described in the following description of several non-limiting embodiments thereof. This description is included solely for the purposes of exemplifying the present invention to the skilled addressee. It should not be understood as a restriction on the broad summary, disclosure or description of the invention as set out above.

In the figures, incorporated to illustrate features of the example embodiment or embodiments, like reference numerals are used to identify like parts throughout. Additionally, features, mechanisms and aspects well-known and understood in the art will not be described in detail, as such features, mechanisms and aspects will be within the understanding of the skilled addressee.

Broadly, the present invention provides for an automated drilling arrangement 10 which facilitates automated drilling through the automatic feeding of drill pipe sections 18 from a drill pipe supply 32 to a drilling mast 22 having a rotary head drive 18 to which a drill string is attached, as known in the art, such drill string comprising a plurality of drill pipe sections 18 that are successively attached to lengthen the drill string as a well is drilled deeper.

In a typical embodiment, the automated drilling arrangement 10 broadly comprises a platform 12, a drill pipe loading assembly 14, and a drilling mast 22 having a rotary head drive 24 displaceable along the mast 22 to effect drilling, as well as a drill pipe manipulator 26 that cooperate as described herein to facilitate automated drilling.

Referring now to the accompanying figures, there is shown one example of the automated drilling arrangement 10, which comprises the platform 12 that supports other components, as described below. The platform 12 may comprise a mobile platform, such as a flatbed truck, a tracked platform, or the like. In other embodiments, the platform 12 may be a stationary platform.

In a typical embodiment, the platform 12 comprises energising means 28 for the drill pipe loading assembly 14 and drilling mast 22, such as an internal combustion engine and electrical, pneumatic and/or hydraulic generator(s) and/or actuator(s) for energising constituent components of the drilling arrangement 10. In the exemplified embodiment, various constituent parts are energised or actuated by means of electrical, pneumatic and/or hydraulic actuators, as shown. When the platform 12 is mobile, such as on a truck, it may also include stabilisers to stabilise the platform 12, or the like. The skilled addressee will appreciate that various parts may be actuated by various means, as required, and that such means is within the understanding of the skilled addressee.

In one embodiment, where the platform is mobile, said platform may comprise an automated or self-driving vehicle platform which is configured to locate the drilling arrangement where required in an automated manner. Similarly, the automated loader 30 may comprise an automated or self-driving vehicle platform to locate the drill pipe supply 32 where required relative to the drilling arrangement 10.

Arrangement 10 also include the drill pipe loading assembly 14 which is arranged on the platform 12 and includes a cradle 16 for receiving a drill pipe section 18. Drill pipe loading assembly 14 also includes a handler assembly 20 which is configured automatically to displace and orientate said drill pipe section 18 from the cradle 16 into an upright position for engagement with a drill string of the rotary head drive 24.

In an embodiment, the cradle 16 of the drill pipe loading assembly 14 comprises at least two pipe roller cradles for receiving a drill pipe section 18 in a substantially horizontal position. One or more of the pipe roller cradles may be powered in order to displace the pipe section 18 along the cradle 16, as required in order to facilitate handling by the handler assembly 20.

In the exemplified embodiment, the cradle 16 is laterally arranged with the drilling mast 22, which maximise use of available space on the platform 12. Such lateral arrangement also allows the cradle 16 to be positioned to receive a section of drill pipe 18 from a side of the platform 12. In such an embodiment, the handler assembly 20 comprises a mechanism configured to grasp a drill pipe section 18 in the cradle 18, hoist the gripped drill pipe section 18 into a substantially upright orientation, and to swivel the upright drill pipe section 18 from proximate the cradle 16 towards the drill string at the mast 22. Additionally, in an embodiment, the handler assembly mechanism 20 is configured to laterally displace the upright drill pipe section 18 underneath the rotary head drive 24. These handling steps are more clearly shown in FIGS. 5 to 12.

As will be appreciated by the skilled addressee, the handler assembly 20 may take various forms, but typically comprises pipe grippers mounted on a pivotable and swivelable framework in order to handle a section of drill pipe 18 as described. Similarly, movement of the handler assembly 20 is effected by means of various actuators in order to actuate the handler assembly 20, as required. Such actuators may comprise pneumatic, hydraulic and/or electromechanical actuators, as known in the art, and are typically powered by means of the energising means 28.

Arrangement 10 also includes the drilling mast 22 which is arranged on the platform 12 and comprises a rotary head drive 24 which is displaceable along the mast 22 to effect drilling, as generally known in the art. In one embodiment, the drilling mast 22 is pivotably arranged on the platform 12 so that the mast 22 is deployable between a transport position, in which the mast 22 lies proximate the platform, and a drilling position, in which the mast 22 is in a substantially upright position to effect drilling. For example, when the platform 12 is on a truck, the mast 22 can be lowered to lie closer to the platform for transport, and can also be deployed into the upright position when drilling.

Importantly, the drilling mast 22 includes the drill pipe manipulator 26 which is configured automatically to receive, align and connect a section of drill pipe 18 from the handler assembly 20 with a drill string of the rotary head drive 24 in order to facilitate automated drilling by the automated drilling arrangement 10. While conventional so-called double breakout clamps are known for use with drill rigs in order to grip and unscrew stuck drill pipe thread during extraction of drill pipe, the drill pipe manipulator 26 of drilling arrangement 10 is specifically configured to effect automated alignment between sections of drill pipe, particularly during threading of such sections (rather than simple unthreading, as via conventional double breakout clamps).

While the drill pipe manipulator 26 may take various forms, in the exemplified embodiment, the drill pipe manipulator 26 comprises at least two pipe clamp pairs 36 that are layered on each other, each pipe clamp pair 36 being configured to clamp or release an end of a drill pipe section 18 in order to facilitate automatic threaded interconnection of successive drill pipe sections 18. Importantly, the at least two pipe clamp pairs 36 are each configured to function independently of the others, as described in more detail below, e.g. the clamp pairs do not operate in unison, as is the case with conventional double breakout clamps. As shown, a pipe clamp pair 36 generally comprises two opposed clamp portions actuated by suitable actuators in order to clamp or release a section of drill pipe.

Figure 16:
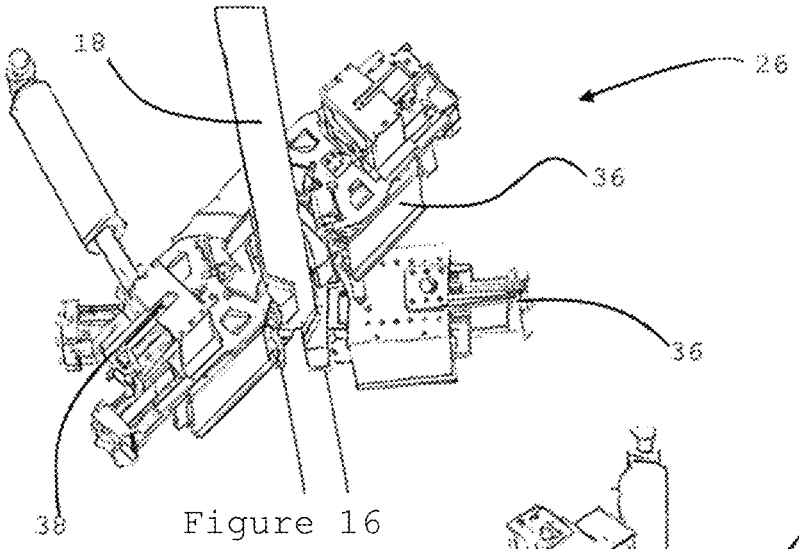
FIG. 16 is a diagrammatic top perspective view representation of the drill pipe manipulator of FIG. 15 showing layered pipe clamp pairs co-axially rotatable about the drill string to facilitate automated threaded interconnection of drill pipe sections.
Figure 17:
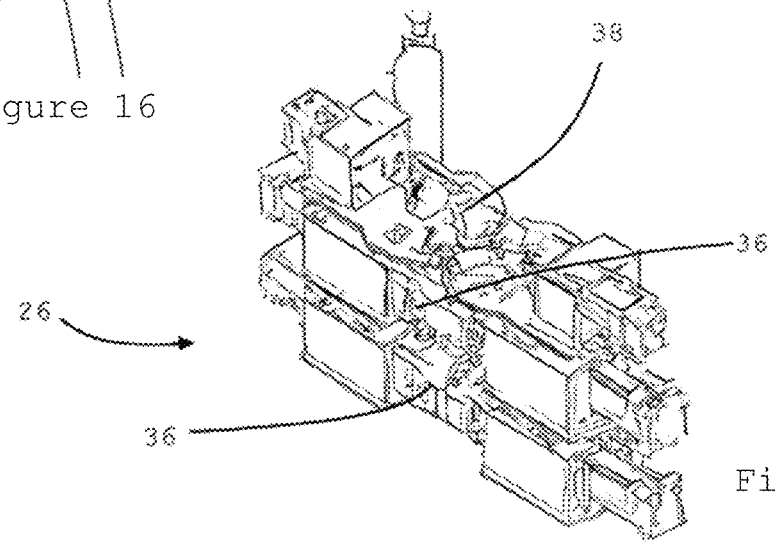
FIG. 17 is a diagrammatic perspective representation of the drill pipe manipulator of FIG. 16 with pipe clamp pairs and pipe aligner in line with each other.
Figure 18:
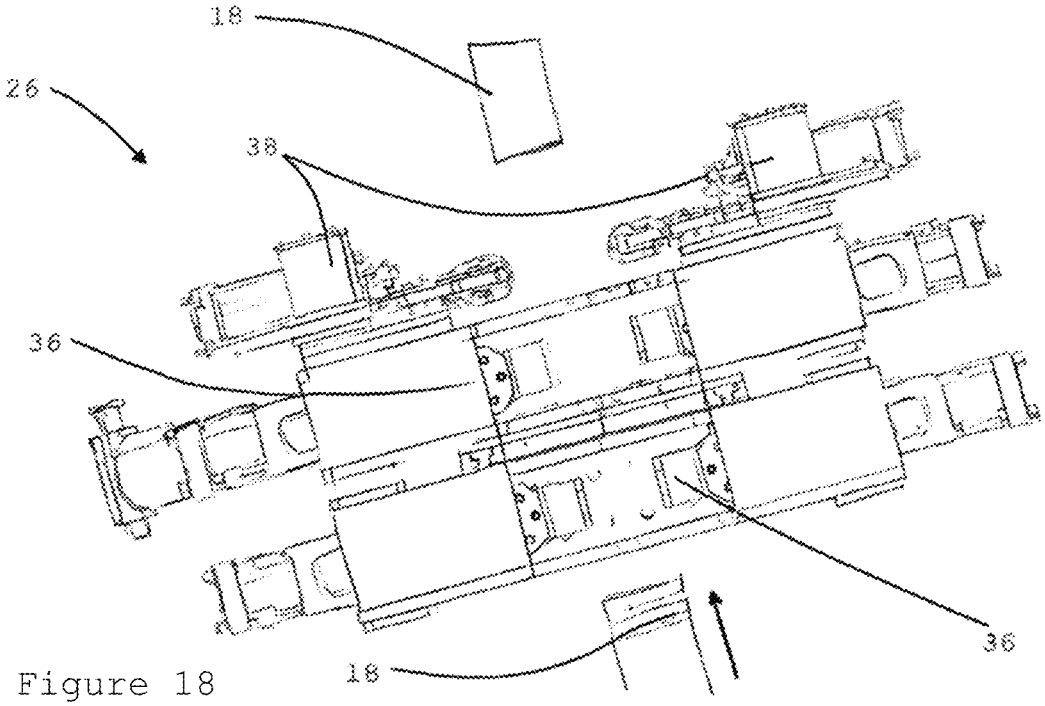
FIGS. 18 to 22 are diagrammatic side-view representations of the drill pipe manipulator of FIG. 15 used to thread drill pipe sections together.
Figure 19:
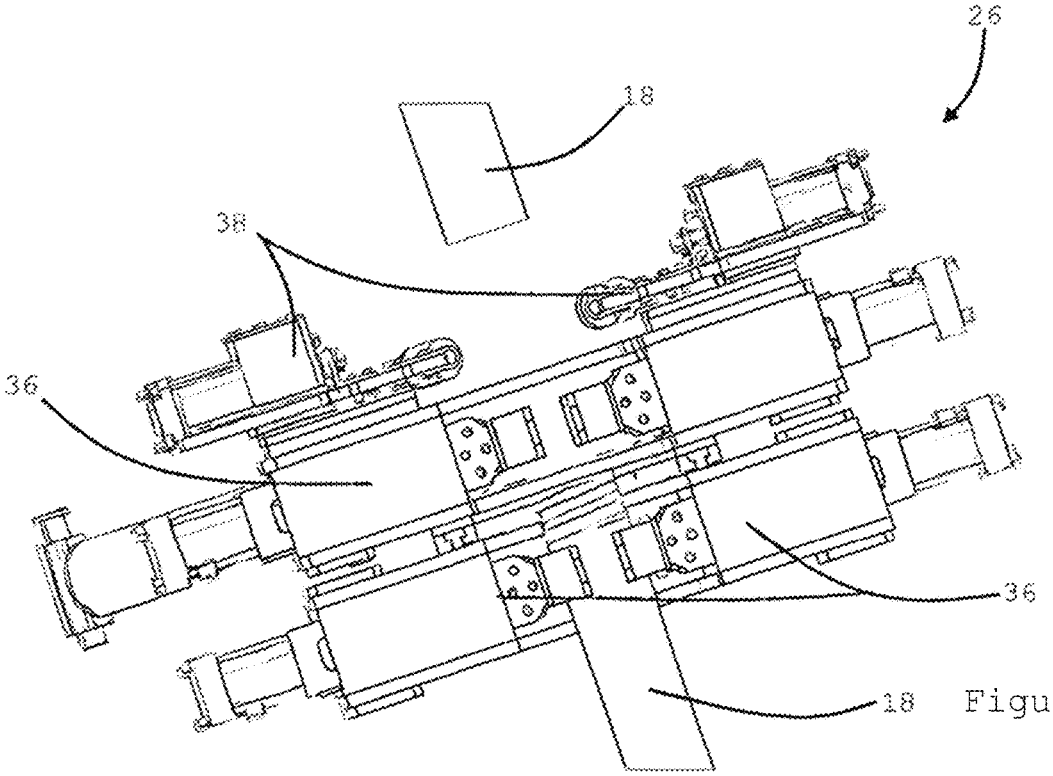
Figure 20:
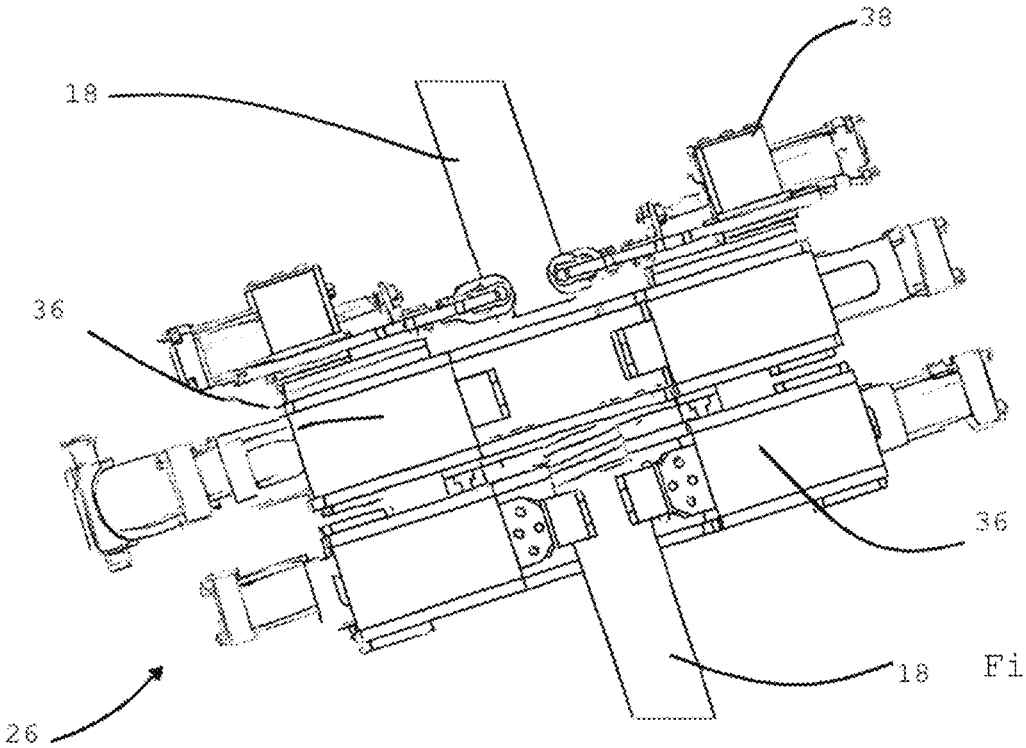
Figure 21:
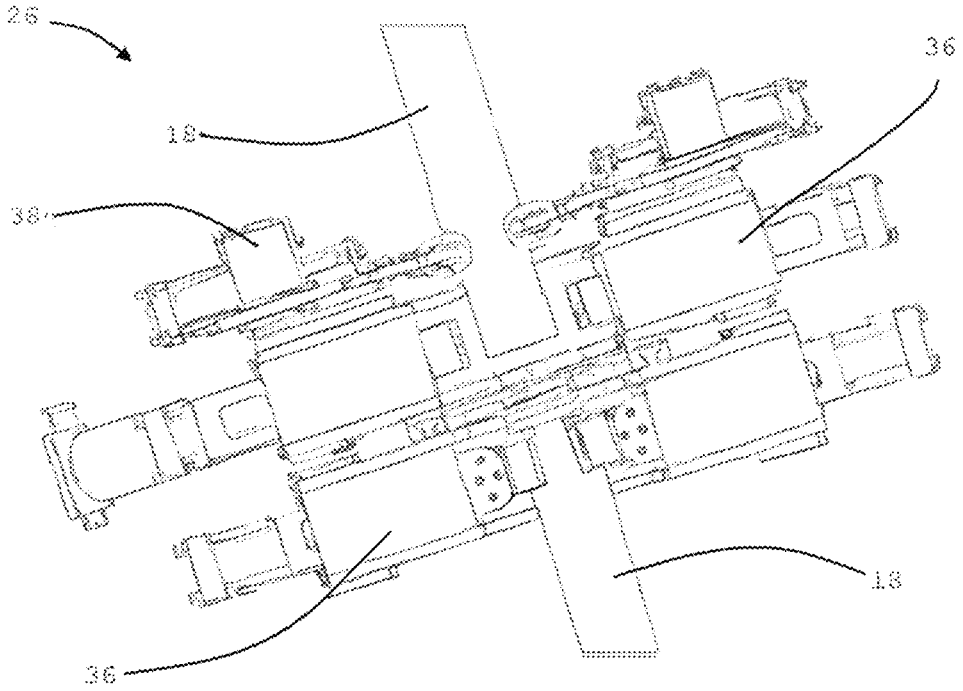
Figure 22:
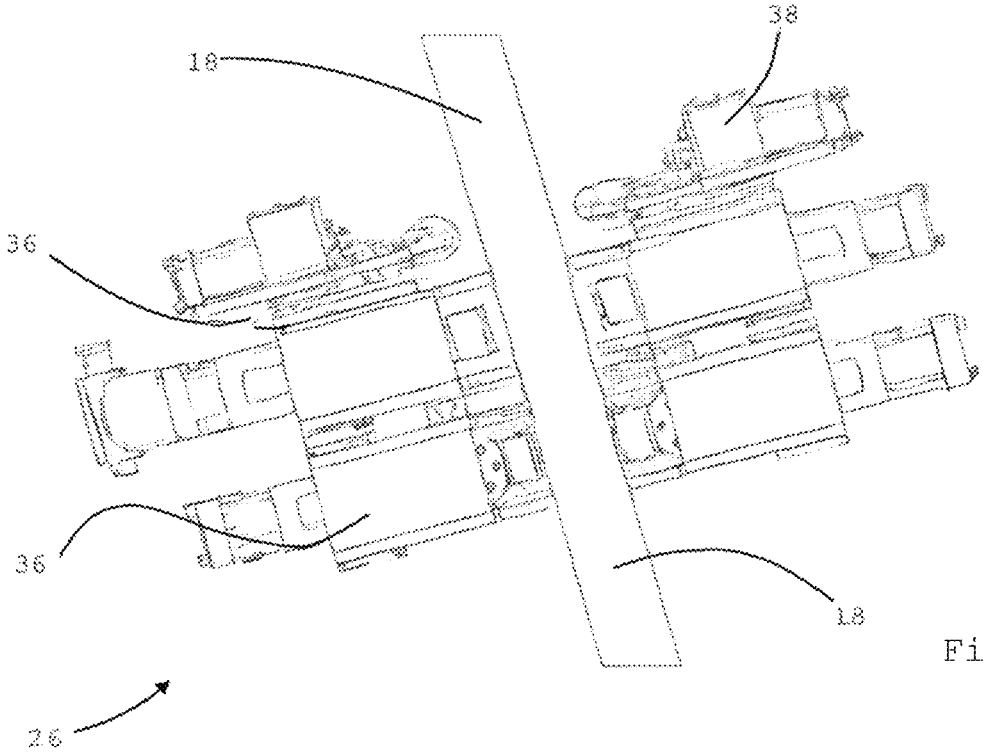

To effect threaded engagement of pipe sections 18, the two layered pipe clamp pairs 36 are rotatably arranged with respect to each other co-axially about such drill pipe sections 18 within the drill pipe manipulator 26 in order to facilitate threaded interconnection of successive drill pipe sections 18. As shown more clearly in FIG. 16, the pipe claim pairs 36 can be individually and independently operated and co-axially rotated relative to each other by means of suitable actuators. For example, FIGS. 18 to 22 show the manner in which the layered pipe clamp pairs 36 cooperate in order to thread an upper pipe section into a lower pipe section. As shown, the respective pipe clamp pairs 36 individually grips a respective pipe section 18 (upper and lower) to allow rotation of the rotary head drive to rotate the upper pipe section to thread onto the lower pipe section of the drill string. Operation of the drill pipe manipulator 26 can also be reversed in order to detach or unscrew drill pipe sections from each other.

Importantly, in one embodiment, the drill pipe manipulator 26 also includes at least one pipe aligner 38 which is layered on (and/or underneath) a pipe clamp pair 36 and which is configured to align an end of a drill pipe section 18 with an end of a successive drill pipe section 18 to facilitate automatic threaded interconnection of said drill pipe sections, as described. In the exemplified embodiment, the pipe aligner 38 comprises pipe rollers for abutting against a drill pipe section to allow an end of the drill pipe section to be displaced laterally whilst the drill pipe section is able to move longitudinally through the drill pipe manipulator 26. In this manner, the pipe aligner 38 aligns the respective drill pipe sections for individual clamping and threading via the layered pipe clamp pairs 36.

In this manner, via use of individually-operable clamp pairs 36 to selectively grip individual upper and lower drill pipe sections, along with pipe aligner 38 to align such drill pipe sections, enables arrangement 10 to align and thread or unthread drill pipe sections automatically and without human intervention.

Figure 23:
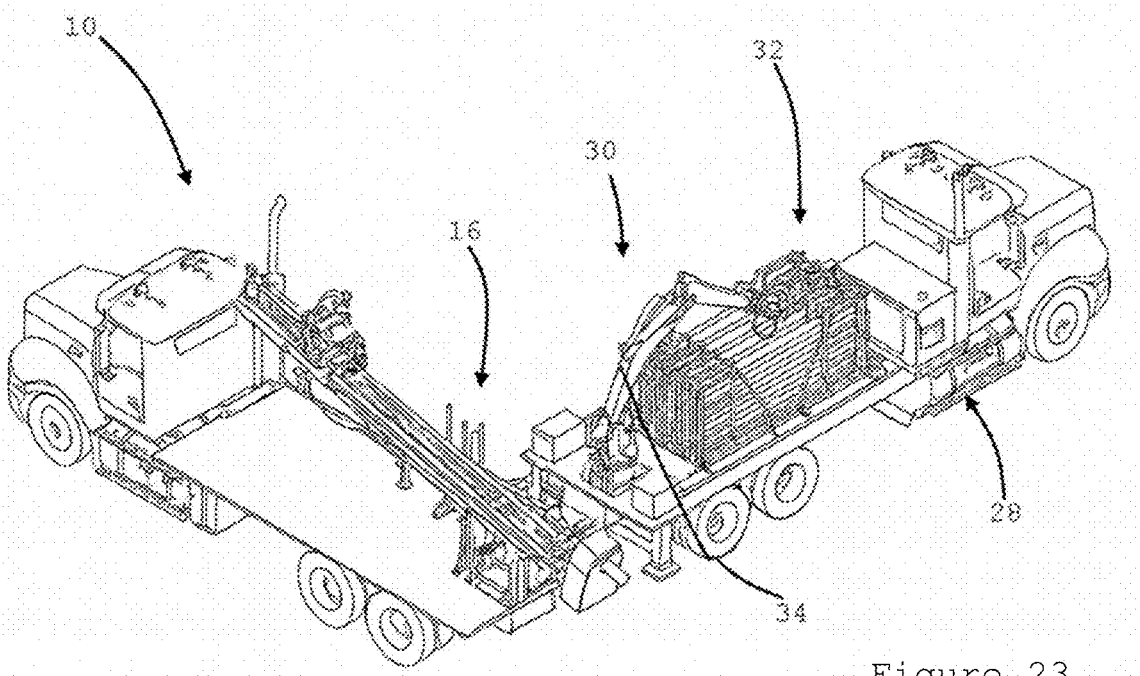
FIG. 23 is a diagrammatic representation of the automated drilling arrangement including an automated loader.
Figure 24:
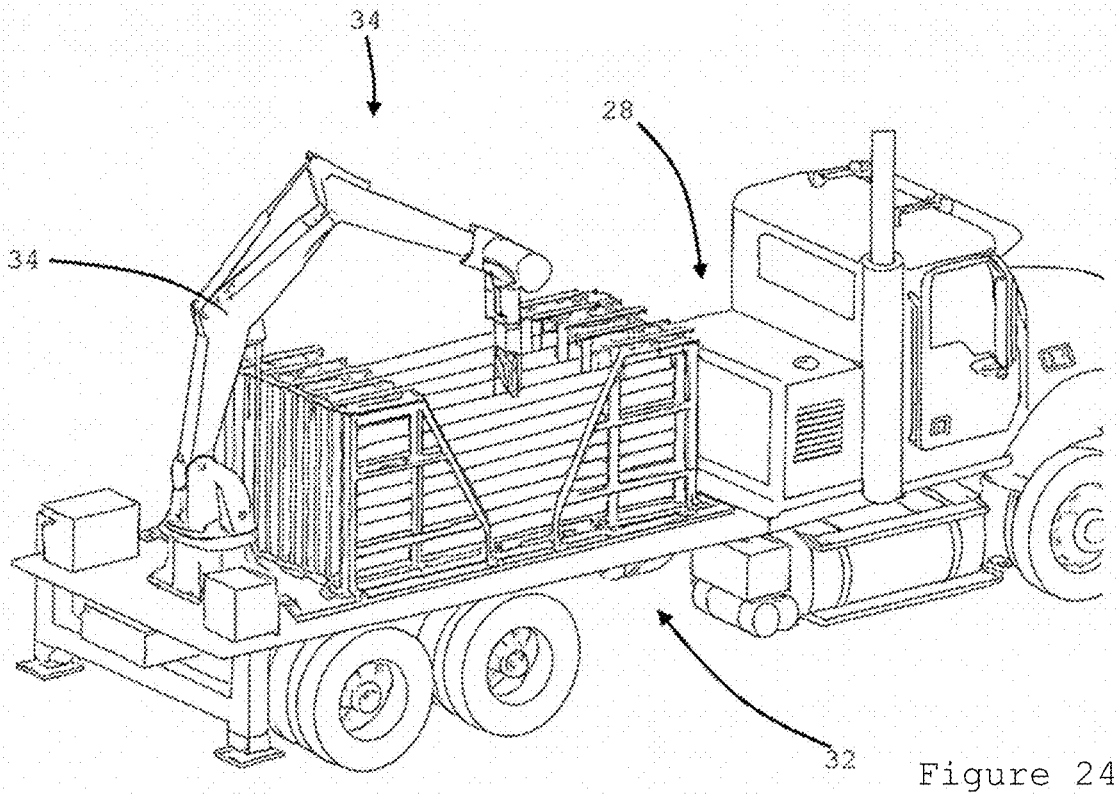
FIG. 24 is a diagrammatic representation of the automated loader of FIG. 23.

In one embodiment, an example of which is shown in FIGS. 23 and 24, the drilling arrangement 10 also includes an automated loader 30 which is configured automatically to load sections of drill pipe 18 from a drill pipe supply 32 onto the cradle 16. In an embodiment, the drill pipe supply 32 comprises a truck loaded with a supply of drill pipe sections 18. In one embodiment, the automated loader 30 comprises a robotic arm 34 which is arranged on the drill pipe supply 32 and is configured automatically to load drill pipe sections from the drill pipe supply onto the cradle 16. As with the platform 12, the automated loader 30 may also include suitable energising means 28. As mentioned above, both the platform 10 and the automated loader 30 may comprises self-driving, automated vehicle platforms to facilitate automated autonomous drilling.

The automated drilling arrangement 10 also typically comprises a control system 40 including sensors for sensing relative positions of drill pipe sections 18 and to complementarily control the energising means 28, actuators, automated loader 30, handler assembly 20, rotary head drive 24 and/or drill pipe manipulator 26, as required, to facilitate automated drilling by the automated drilling arrangement 10.

As will be appreciated by the skilled addressee, such a control system 40 with appropriate sensors may take a variety of forms. For example, in one embodiment, a programmable logic controller (PLC) may be used along with suitable proximity, limit and/or computer vision sensors to determined position and actions of constituent parts. The skilled addressee is further to appreciate that reference to such 'computer vision' generally refers to any suitable technology for building artificial systems that obtain information from images or multi-dimensional data, and any suitable configuration that deals with how computers or similar processing systems are able to gain a high-level and/or detailed understanding from digital images or videos, i.e. automating tasks that the human visual system is able to perform, as is known in the art of computer and visual engineering.

In particular, control system 40 is generally configured to accurately monitor and track a position of constituent parts of the drill pipe manipulator 26, such as the pipe clamp pairs 36 and pipe aligner 38, in order to effect suitable alignment and threaded of individually-manipulable drill pipe sections thereby, as described above.

The skilled addressee is also to appreciate that operation of the automated loader 30, loading assembly 12, handler assembly 20, rotary head drive 24 and drill pipe manipulator 26 as part of the overall operation of the drilling arrangement 10 is generally reversible in order to remove drill pipe sections 18 from a well. Accordingly, description of such drilling operation herein includes an inverse order, as appropriate, for automatically removing and storing drill pipe sections 18.

The skilled addressee is to appreciate that the present invention includes an associated method of drilling. Such a method broadly comprises the step of providing the automated drilling arrangement 10 comprising the platform 12 with the drilling mast 22 arranged thereon and including the rotary head drive 24 displaceable along the mast 22 to effect drilling, the drill pipe loading assembly 14 arranged on the platform 12 and including the cradle 16 for receiving a drill pipe section 18.

The method also includes a step of automatically displacing and orientating the drill pipe section 18, by means of the automated handler assembly 20 on the platform, from the cradle 16 into an upright position for engagement with a drill string of the rotary head drive 24, and automatically receiving, aligning and connecting the section of drill pipe 18 from the handler assembly 20, by means of the drill pipe manipulator 26, with the drill string of the rotary head drive 24, and subsequently drilling with the drill string.

Similar to the automated drilling arrangement 10 described above, the method of drilling is equally applicable when removing a drill string from a borehole, where steps to drill a well can be generally reversed in order to remove drill pipe sections 18 from a drill string. As such, while such reverse actions are not described in detail herein, they will be readily apparent to the skilled addressee.

Applicant believes it particularly advantageous that the present invention provides for an automated drilling arrangement 10 which is able to reduce conventional labour-intensive drilling approaches, while also removing personnel from potentially dangerous working environments during such drilling work.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a", "an", "said", "the", and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. As used herein, the term "and/or" includes any and all combinations of one or more of the associated listed items. No language in the specification should be construed as indicating any non-claimed subject matter as essential to the practice of the claimed subject matter.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures.

It is to be appreciated that reference to "one example" or "an example" of the invention, or similar exemplary language (e.g., "such as") herein, is not made in an exclusive sense. Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise. Variations (e.g. modifications and/or enhancements) of one or more embodiments described herein might become apparent to those of ordinary skill in the art upon reading this application. The inventor(s) expects skilled artisans to employ such variations as appropriate, and the inventor(s) intends for the claimed subject matter to be practiced other than as specifically described herein.

Any method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. An automated drilling arrangement comprising:

a platform;

a drill pipe loading assembly arranged on the platform and including a cradle for receiving drill pipe section, and a handler assembly configured automatically to displace and orientate said drill pipe section from the cradle into an upright position for engagement with a drill string; and a drilling mast arranged on the platform and comprising a rotary head drive displaceable along the mast to effect drilling, and a drill pipe manipulator configured automatically to receive, align and connect said section of drill pipe from the handler assembly with a drill string of the rotary head drive to facilitate automated drilling by the automated drilling arrangement;

wherein said drill pipe manipulator comprises at least two pipe clamp pairs layered on each other, the pipe clamp pairs each configured individually and selectively to clamp or release an end of two separate drill pipe sections and individually and selectively to rotate co-axially about an end of a drill pipe section, to facilitate automatic threaded interconnection of such two successive drill pipe sections; whereby each pipe clamp pair is operable to effect controlled threaded engagement and disengagement of successive drill pipe sections during automated drilling operations;

wherein each of the at least two pipe clamp pairs is individually operable and not mechanically linked for synchronous rotation, thereby enabling selective threaded engagement of successive drill pipe sections; and wherein the drill pipe manipulator comprises at least one pipe aligner layered on a pipe clamp pair and which is configured to align an end of one drill pipe section with an end of a successive drill pipe section via said pipe aligner configured to displace an end of the drill pipe section laterally and comprising pipe rollers for abutting against a drill pipe section to allow the drill pipe section to move longitudinally through the drill pipe manipulator.

2. The drilling arrangement of claim 1, wherein the platform comprises a mobile platform.

3. The drilling arrangement of claim 1, wherein the platform comprises energising means for the drill pipe loading assembly and drilling mast, comprising an internal combustion engine and electrical coupling to a generator adapted for energising constituent components of the drilling arrangement.

4. The drilling arrangement of claim 1, which includes an automated loader configured automatically to load sections of drill pipe from a drill pipe supply onto the cradle.

5. The drilling arrangement of claim 4, wherein the drill pipe supply comprises a truck loaded with a supply of drill pipe sections.

6. The drilling arrangement of claim 4, wherein the automated loader comprises a robotic arm arranged on the drill pipe supply and configured automatically to load drill pipe sections from the drill pipe supply onto the cradle.

7. The drilling arrangement of claim 1, wherein the cradle of the drill pipe loading assembly comprises at least two pipe roller cradles for receiving a drill pipe section in a substantially horizontal position.

8. The drilling arrangement of claim 1, wherein the cradle is laterally arranged with the drilling mast.

9. The drilling arrangement of claim 1, wherein the handler assembly comprises a mechanism configured to grasp a drill pipe section in the cradle, hoist the gripped drill pipe section into a substantially upright orientation, and to swivel the upright drill pipe section from proximate the cradle towards the drill string.

10. The drilling arrangement of claim 9, wherein the handler assembly mechanism is configured to laterally displace the upright drill pipe section underneath the rotary head drive.

11. The drilling arrangement of claim 1, wherein the drilling mast is pivotably arranged on the platform so that the mast is deployable between a transport position, in which the mast lies proximate the platform, and a drilling position, in which the mast is in a substantially upright position to effect drilling.

12. The drilling arrangement of claim 1, wherein the two layered pipe clamp pairs are rotatably arranged with respect to each other co-axially about drill pipe sections within the drill pipe manipulator to facilitate threaded interconnection of successive drill pipe sections.

13. The drilling arrangement of claim 12, which comprises a control system including sensors for sensing relative positions of drill pipe sections and to complementarily control energising means, platform, actuators, automated loader, handler assembly, and/or drill pipe manipulator, as required, to facilitate automated drilling by the automated drilling arrangement.

14. The drilling arrangement of claim 13, wherein the control system is configured to accurately monitor and track a position of the at least two pipe clamp pairs and pipe aligner in order to effect automated alignment and threaded engagement of individually-manipulable drill pipe sections.

15. A method of drilling, said method comprising the steps of:

providing an automated drilling arrangement in accordance with claim 14;

automatically displacing and orientating a drill pipe section, by means of the automated handler assembly on the platform, from the cradle into an upright position for engagement with a drill string of the rotary head drive;

automatically receiving, aligning and connecting the section of drill pipe from the handler assembly, by means of the drill pipe manipulator of the drilling mast, with the drill string of the rotary head drive;

whereby at least two individually-operable pipe clamp pairs selectively clamp, release, and rotate co-axially about respective ends of drill pipe sections to effect controlled threaded engagement and disengagement of successive drill pipe sections during automated drilling;

and drilling with the drill string.

* * * * *